United States Patent [19]

Landry

[11] 4,397,110

[45] Aug. 9, 1983

[54] HAND AND IMPROVED HAND SPRING FOR SINGLE ACTION FIREARM

[75] Inventor: Archie C. Landry, Canoga Park, Calif.

[73] Assignee: North American Mfg. Corp., Spanish Fork, Utah

[21] Appl. No.: 333,990

[22] Filed: Dec. 23, 1981

Related U.S. Application Data

[63] Continuation-in-part of Ser. No. 98,870, Nov. 30, 1979, Pat. No. 4,316,341.

[51] Int. Cl.[3] ..... F41C 1/00

[52] U.S. Cl. ..... 42/65

[58] Field of Search ..... 42/67, 66, 65, 59

[56] References Cited

U.S. PATENT DOCUMENTS

| | | | |
|---|---|---|---|
| 3,733,730 | 5/1973 | Baker | 42/65 |
| 3,777,384 | 12/1973 | Ruger et al. | 42/66 |
| 3,824,728 | 7/1974 | Kennedy | 42/66 |
| 4,228,607 | 10/1980 | Casull | 42/66 |

*Primary Examiner*—Charles T. Jordan

*Attorney, Agent, or Firm*—Gene W. Arant; Thomas I. Rozsa

[57] ABSTRACT

An improved revolver hand and hand spring which permits the revolver to accommodate a multiplicity of approximately equal hand lengths.

4 Claims, 7 Drawing Figures

100
20
21a
21b
21c
21d
21e
30
31
33
70
71
172
173
174
175
180
183
184
190
192
194
200
202
2

HAND AND IMPROVED HAND SPRING FOR SINGLE ACTION FIREARM

This application is a continuation-in-part of presently pending U.S. patent application Ser. No. 06/098,870, filed Nov. 30, 1979, now U.S. Pat. No. 4,316,341.

BACKGROUND OF THE INVENTION

1. Field of the Invention

The present invention relates to revolvers, handguns, and other firearms having an external hammer, and in particular to the hand or pawl in the firearm for rotating the cylinder and driving it to its next firing position, and for the hand spring located directly behind the hand or pawl which assists in urging the hand or pawl into its operating position.

2. Prior Art

The present invention relates to firearms including but not limited to those having an external hammer which must be manually cocked before the trigger can be pulled. The hammer is functionally incapable of being cocked simply by pulling the trigger, as is the case with double action firearms. Such firearms include single action revolvers, single shot rifles, and the like. All of these firearms share in common a hand or cylinder pawl which is pivotally mounted on the hammer or similar portion of the mechanism by means of a pin or stud. The upper end of the cylinder pawl engages the cylinder ratchet at the rearward end of the cylinder, thereby causing the cylinder to rotate when the hammer is rotated backward to its cocked position. Located directly behind the hand or cylinder pawl is the hand spring, which assists in urging the hand forward into its operating position.

Prior art patents include the following: U.S. Pat. No. 566,393 issued to Fyrberg, U.S. Pat. No. 658,314 issued by Bye; and U.S. Pat. No. 3,777,384 issued to Rugger et al. In each of the three above referenced United States patents, the hand has a hole machined into its lower portion to accommodate a pin or stud by which the hand or pawl is attached to the hammer. Though not discussed in the specification of any of the patents, it is apparent from the figures that the pin or stud fits tightly into the hole in the hand or pawl, and there is very little if any room for the pin or stud to move within the hand or pawl. None of these patents discuss or indicate in the drawings the use of a hand spring directly behind the hand.

A common type of hand or pawl is used in the Colt Single Action Army Revolver. In this embodiment, the lower portion of the hand has a button attached into it and the button is used to pivotally mount the hand to the hammer. Located directly behind the hand is a hand spring which is fixed to the hand at its lower portion.

The hand is one of the last elements to be placed into the finished revolver. As a result, it is usually necessary to fit the hand into the revolver after all of the other elements have been placed in the revolver. It is frequently necessary to hand stone or hand machine each hand or pawl so that it fits properly within the revolver. Since the forward position of the hand is involved in rotating the cylinder during each firing of the gun, the forward portion of the hand is subject to extensive were and tear. When the forward end of the hand becomes sufficiently worn so that it can no longer rotate the cylinder properly, the gun must be torn apart to replace the worn hand with a new hand which once again must be individually fitted to the specific gun.

Additionally, with the precise fitting of the pivot pin or stud inside the lower portion of the hand, there is no extra longitudinal movement provided for the hand. Therefore, if the hand becomes slightly worn and is a little too short, the cylinder would not be indexed completely around to its next revolution if the hammer is cocked backward very slowly. Also, due to the lack of longitudinal play in the hand, if the hand is initially too long, it could create a mechanical bind as it engages the ratchet, thereby also failing to properly rotate the cylinder to its next revolution. Therefore, the precise fitting is necessary to be sure that the hand fits properly within the revolver and further to assure that the hand is not too long or too short so that the risk of mechanical binding and improper indexing of the cylinder is eliminated.

All of the designs for a hand or pawl discussed in the three referenced patents and in the Colt single action army revolver have the inherent problems discussed above. There is no longitudinal play for the hand since the pin or stud in the hand used in the gun of the three referenced patents fits precisely within the hole in the lower portion of the hand and the button in the hand of the Colt single action army revolver is rigidly attached to the lower portion of one side of the hand. The hand spring of the Colt single action army revolver is rigidly attached to the lower rear portion of the hand, and also offers no assistance in increasing the longitudinal play of the hand.

SUMMARY OF THE INVENTION

It has been discovered, according to the present invention, that if the area where the pivot pin extends transversely through the hand is opened to allow longitudinal movement of the hand, the hand will properly engage the ratchet at the rear portion of the cylinder over several approximately equal hand lengths due to the ability of the hand to adjust to varying distances from the cylinder ratchet because of the hand's ability to move longitudinally in the area of the pivot pin.

It has further been discovered, according to the present invention, that if the hand spring whose primary function is to urge the hand into engagement with the ratchet at the rear of the cylinder, is extended so that its rear portion is formed comparable to the shape of the rear portion of the hand such that the hand spring terminates by abutting a portion of the pivot pin adjacent the open area within the hand, the hand spring additionally provides a flexible wall to enable the hand to move in a restricted longitudinal fashion in the area of the pivot pin. Therefore, the improved design of the hand spring provides the flexibility required to enable various hand lengths to be accommodated within the revolver while at the same time providing a resistance to eliminate completely free longitudinal movement of the hand.

It has additionally been discovered, according to the present invention, that if the hand and the hand spring are formed such that one end of the hand spring abuts a portion of the transverse pivot pin and the area of the hand adjacent the pivot pin is opened to allow flexible movement of the hand spring within that area of the hand, it is possible to mass produce the hand for use in all revolvers of a particular design because modest differences in length can be accommodated due to the restricted longitudinal movement of the hand in the area of the pivot pin. Additionally, this feature enables the manufacturer to produce a hand slightly longer than the length required for an exact fit. This increased length can be accommodated by the flexible moving hand and the increased length assures that the risk of improper indexing of the cylinder ratchet due to a hand being too short is eliminated. Further, the increased length allows for additional wear on the hand and therefore increases its useful life before excessive wear requires it to be replaced. As the forward end becomes worn, the flexible longitudinal movement permitted by the present invention allows the slightly shorter hand to still be useful in properly indexing the cylinder.

it is therefore, an object of the present invention to provide a hand and hand spring for a gun which enables the hand to move in a flexible restricted fashion in a longitudinal direction in the area of its pivot pin to enable various approximately equal hand lengths to be used inside the same model single action revolver.

It is another object of the present invention to provide a hand which can be mass produced and fit into all single action revolvers of a particular model without the necessity of hand stoning or hand machining each hand to accommodate each specific revolver.

It is a further object of the present invention to provide an improved hand design and hand spring design which will enable the hand to be manufactured slightly longer than usual to give the hand a longer useful life and to make the hand functional even after it has become worn subsequent to frequent use. This will reduce the incidence of costly gun repairs.

It is another object of the present invention to provide an improved hand design and improved hand spring design which will enable the hand to be manufactured slightly longer than a precise fit, to assure that the hand will always engage the ratchet at the rear of the cylinder, and to assure that the cylinder will be completely rotated the appropriate amount to bring the next bullet in line with the firing chamber.

It is still another object of the present invention to provide a hand and hand spring which are readily interchangeable from one revolver to the next. Therefore, it is not necessary to have an expert gunsmith install a new hand and hand spring if the old ones should break.

Further novel features and other object of the present invention will become apparent from the following detailed description, discussion and the appended claims taken in conjunction with the drawings.

DRAWING SUMMARY

Referring particularly to the drawings for the purposes of illustration and not limitation there is illustrated:

DETAILED DESCRIPTION OF THE PREFERRED EMBODIMENT

Figures 1, 2, 5:
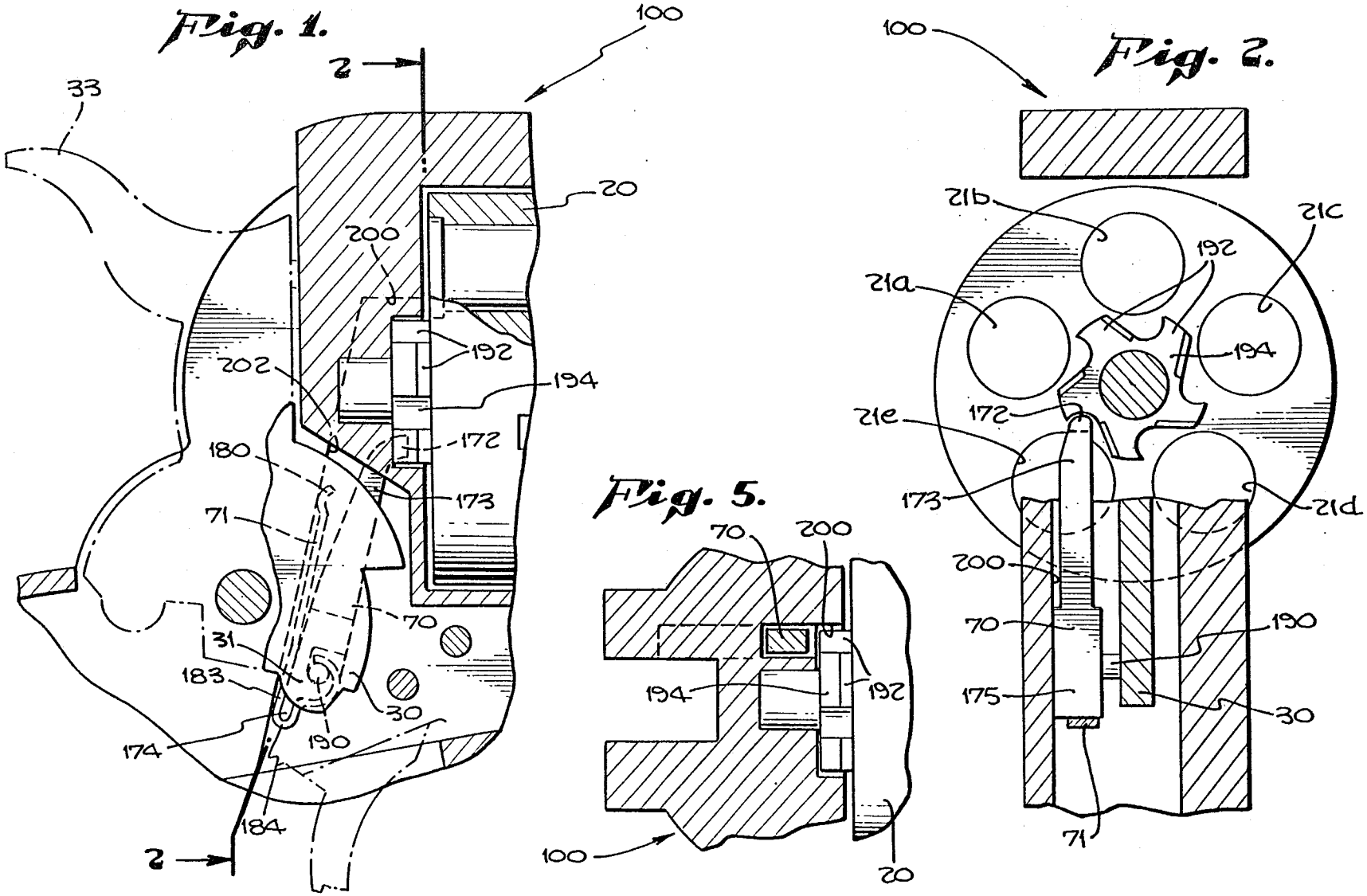
FIG. 1 is a side sectional view of the rear portion of a revolver, showing the revolver in the fired position and the hand withdrawn from the ratchet.
FIG. 2 is a vertical sectional view taken along line 2—2 of FIG. 1.
FIG. 5 is a horizontal sectional view taken along line 5—5, of FIG. 3.

With reference to the drawings of the invention in detail, the location of the improved hand and improved hand spring within the revolver 100 or handgun is shown in FIG. 1. The surrounding parts of the single action revolver were described in detail in currently pending U.S. patent application Ser. No. 06/098,870, filed Nov. 30, 1979, now U.S. Pat. No. 4,316,341. The rotational advance of the cylinder 20 from one firing position to the next is accomplished by generally concentrical means, utilizing a hand or pawl carried on the left side of hammer 30. The hand 70 is seen in dotted lines in FIG. 1. It engages a tooth of a ratchet, not specifically shown in FIG. 1 but shown in detail in FIGS. 2 and 4, on the rearward end of cylinder 20, for rotatingly driving the cylinder 20 to its next firing position. A hand spring 71 associated with the hand 70 is also shown in dotted lines in FIG. 1.

The improved hand 70 is made of one piece construction which includes a forward tip 172, a forward shank portion 173, a rearward shank portion 175, a rear portion 174, a circular opening 176 adjacent the rear portion 174, and an internal open area 178 adjacent the circular opening 176. These elements are shown in FIG. 1. A detailed view of the lower portion of the hand 70 is also shown in FIG. 6, where the elements in the lower portion of the hand are disclosed in greater detail.

The improved hand spring 71 is made of one piece construction which includes a forward tip 180, a forward shank portion 182, a rearward shank portion 183, a rear portion 184, a circular opened portion 186, and an end section 188. These elements are shown in FIG. 1. A detailed view of the lower portion of the hand spring 71 is also shown in FIG. 6, where the elements in the lower portion of the hand spring are disclosed in greater detail.

Figures 3, 4, 6, 7:
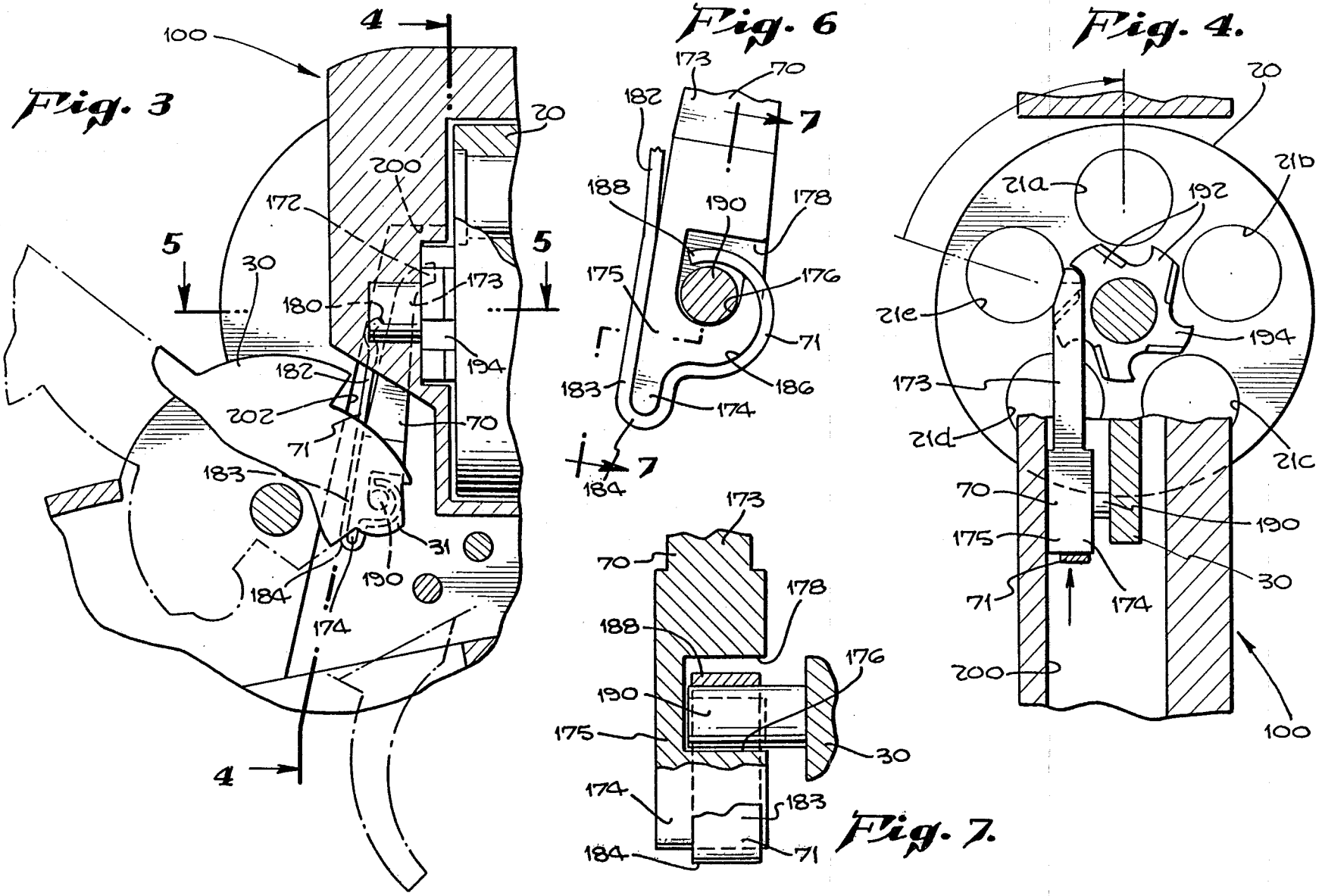
FIG. 3 is a side sectional view of the rear portion of a revolver, showing the revolver in the cocked position with the hand raised and engaging the ratchet.
FIG. 4 is a vertical fragmentary sectional viw taken along line 4—4 of FIG. 3.
FIG. 6 is an enlarged detail view of the lower portion of the hand and the hand spring mounted on it.
FIG. 7 is an enlarged fragmentary sectional view taken along line 7—7 of FIG. 6.

The detailed view of the hand 70 and hand spring 71 as they are located inside the revolver 100 is shown in FIGS. 1 and 3. They fit within an elongated cavity 200 inside the revolver or handgun 100. The areas where they come in contact are at their respective rear portions which are shown in FIG. 6. The hand spring 71 is placed directly behind the hand 70 such that the rearward shank portion 183 of the hand spring 71 abuts the rearward shank portion 175 of the hand 70. Additionally, the rear portion 184 of the hand spring 71 is shaped comparable to the rear portion 174 of the hand 70, so that the rear portion 184 of the hand spring 71 approximately abuts the rear portion 174 of the hand 70. The end section 188 of the hand spring 71 terminates within the internal open area 178 of the hand 70. Also shown in FIGS. 1, 3 and 6 is the pivot pin 190 by which the hand 70 is attached to a portion of the hammer 30. The pivot pin 190 extends transversely through the circular opening 176 in the hand 70. As can be seen from FIGS. 6 and 7, the end section 188 of the hand spring 71 abuts a portion of the pivot pin 190. Therefore, most of the pivot pin 190 is surrounded by the hand 70, but one portion of the circumference of the pivot pin 190 abuts the end section 188 of the hand spring 71. There is also some additional open space 178 between the hand spring's end section 188 and the forward shank portion 173 of the hand 70, thereby allowing room for the hand 70 to move in a longitudinal direction in the area of the opening 178 adjacent the circular opening 176 and pivot pin 190.

The pivot pin 190 is attached to the hammer 30 at the lower forward portion of the hammer base 31. As shown in FIG. 1, when the revolver 10 is in its neutral or fired position, the pivot pin 190 is down low on the revolver and there is no significant amount of tension against the end section 188 of the hand spring 71. As further shown in FIG. 19, the rear portion of the hand spring 71 abuts the rear portion of the hand 70, as previously discussed. The forward shank portion 182 of the hand spring 71 rests adjacent the rear wall 202 of cavity 200 and slides up and down against the wall 202 as the hand 70 is actuated.

The revolver 100 is shown in its cocked position in FIG. 3. When the thumb tab 33 of the hammer 30 is cocked backwards, the pivot pin 190 moves upward while the hammer 30 moves backward. The hand 70 is thereby forced to move upward such that the forward tip 172 of the hand 70 engages one of a multiplicity of teeth 192 in the cylinder ratchet 194 located on the rear face of the cylinder 20. As shown in FIG. 3, this creates a stress tension on the hand spring 71 so that the hand spring 71 is forced away from the hand 70. The forward shank portion 182 of the hand spring 71 rests against the rear wall 202 at cavity 200.

The revolver 100 contains a cylinder 20 which has a multiplicity of bullet chambers 21*a*, 21*b*, 21*c*, 21*d*, and 21*e*, as shown in FIGS. 2 and 4. At the rear portion of the cylinder 20 is a ratchet 194 which contains a multiplicity of teeth 192. When the revolver is in its neutral or fired position shown in FIG. 2, the hand 70 does not engage any of the teeth 192 of the ratchet 194. The effect of the rearward cocking of the hammer 30 is shown in FIG. 4. The rearward cocking of the hammer 30 causes the hand 70 to move upward and forward so that the end tip 172 of the hand 70 engages one of the teeth 192 of the ratchet 194. The hand 70 therefore rotates the ratchet 194 and the cylinder in a circular direction, thereby indexing the cylinder 20 and causing the cylinder 20 to move an appropriate amount so that the next bullet is brought in line with the firing chamber. In the case of a cylinder with five bullet chambers as shown in the drawings, the amount of the rotation is 72 degrees. The hand spring 71 also urges the hand 70 forward and upward to rotate the cylinder 20 properly.

Although the specific embodiments have been described as a hand 70 and a hand spring 71, the hand 70 can be considered to be an elongated actuating member 70 which progressively rotates the cylinder 20 from one firing position to the next, and the hand spring 71 can be considered to be an associated resilient means 71 which permits the pivot pin 190 to move from one end of the opening 176 in the elongated actuating member 70 to the other end of the opening 178 in the elongated actuating member 70.

An improvement in the hand 70 consists of the fact that the hand 70 is allowed some longitudinal movement in the area of the pivot pin 190 and the hand's opening 178. A second improvement in the combination of the hand 70 and hand spring 71 is that the hand spring's end section 188 abuts a portion of the pivot pin 190, thereby, providing some resistance against the free movement of the hand 70. In this fashion, the pivot pin 190 is restricted by the hand spring end section 188 so that the hand 70 is allowed flexible restricted movement. If the hand 70 is too long, the flexibility of the hand spring end section 188 against the pivot pin 190 allows the pivot pin 190 to push the hand spring end section 188 further into the open area 178 of the hand 70 and enables the hand 70 to move away from the ratchet 194 an appropriate amount so that the tip 172 can engage the appropriate tooth 192 and rotate the cylinder 20 by the desired amount. In the event that the hand 70 becomes worn so that it is slightly too short, the force of the hand spring 71 which surrounds the rear 174 of the hand 71 enables the hand tip 172 to be pushed upward and forward the needed extra amount so that the tip 172 can properly engage the appropriate tooth 192 of the ratchet 194 and rotate the cylinder 20 the desired amount.

The combined design of having the rear portion 184 of the hand spring 71 shaped comparable to the rear portion 174 of the hand 70, and having the open area in the hand 178 accommodating the end section 188 of the hand spring 71 such that the hand spring 71 terminates in the open area 178 and abuts a portion of the pivot pin 190, enables the hand 70 to move in a restricted longitudinal fashion such that a multiplicity of approximately equal hand lengths can be used to perform the requied task. The spring force compensates for the slight differences in required length. As a result, it is not necessary to precisely fit each hand 70 and hand spring 71 to each gun. Instead, the hand and hand spring can be mass produced and slight differences in length can be accommodated. Also, by making the hand slightly longer than an exact fit, the hand can take more wear and tear and still be functional as it beomes shorter. This increases its useful life and reduces the incidence of costly gun repair. Therefore, the improved design allowing for restricted flexible hand movement in a longitudinal direction can accommodate the slightly longer hand and can also make the hand functional as it becomes shorter due to wear and tear resulting from frequent gun firings.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. An improved revolver hand and improved revolver hand spring in which the hand contains a circular transverse opening to accommodate a pivot pin, wherein the improvement comprises:

a. an internal open area within the hand adjacent said pivot pin which accommodates a portion of the end of said hand spring which abuts said pivot pin;

b. whereby the hand is allowed flexible but restricted longitudinal movement at the location of the internal open area.

2. The combination of an improved revolver hand and improved revolver hand spring wherein the improvement comprises:

a. a hand made of one piece construction which includes a rearward shank portion, a rear portion, a circular opening adjacent the rear portion, and an internal open area adjacent the circular opening;

b. a hand spring made of one piece construction which includes a rearward shank portion, a rear portion and an end section;

c. said hand spring located directly behind said hand so that their respective rear shank portions abut each other;

d. the rear portion of said hand spring being shaped comparable to the rear portion of said hand so that the two respective rear portions abut each other;

e. a transverse pivot pin attached to the hammer of the revolver and accommodated within said circular opening in said hand; and f. the end section of said hand spring terminating within said internal open area of said hand such that the end section of said hand spring abuts said pivot pin when it is inserted into said circular opening of said hand;

g. whereby the combination of said internal opening within said hand and adjacent said pivot pin and the end section of said hand spring abutting said pivot pin enables said hand to move in a flexible but restricted longitudinal direction to permit the revolver to accommodate a multiplicity of approximately equal hand lengths.

3. The combination of an improved revolver hand and improved revolver hand spring wherein the improvement comprises:

a. a longitudinal revolver hand made of one piece construction containing a forward tip, a forward shank portion, a rearward shank portion, a rear portion, a circular opening adjacent the rear portion, and an internal open area adjacent the circular opening;

b. a longitudinal revolver hand spring made of a piece construction containing a forward tip, a forward shank portion, a rearward shank portion, a rear portion, a circular opened portion and an end section;

c. said longitudinal hand spring located directly behind said longitudinal hand so that their respective rear shank portions abut each other;

d. the rear portion of said longitudinal hand spring being shaped comparable to the rear portion of said longitudinal hand so that the two respective rear portions abut each other;

e. a transverse pivot pin attached to the hammer of said revolver and accommodated within said circular opening in said longitudinal hand; and f. the end section of said longitudinal hand spring terminating within said internal open area of said longitudinal hand such that the end section of said longitudinal hand spring abuts said pivot pin when it is inserted into said circular opening of said longitudinal hand;

g. whereby the combination of said internal opening within said longitudinal hand and adjacent said pivot pin and the end section of said longitudinal hand spring abutting said pivot pin enables said longitudinal hand to move in a flexible but restricted longitudinal direction to permit the revolver to accommodate a multiplicity of approximately equal hand lengths.

4. In a hand gun having a revolving cylinder which contains a multiplicity of bullet chambers, an improved elongated actuating member and associated resilient means where the improvement comprises:

a. an elongated actuating member for progressively rotating the cylinder from one firing position to the next;

b. said actuating member having an opening therethrough which is elongated along the length of said member;

c. a pivot pin extending transversely through said opening and normally occupying one end of said opening;

d. a resilient means containing a portion which extends into said opening in said actuating member and which abuts said pivot pin; and e. said resilient means permitting said pivot pin to move toward the other end of said opening;

f. whereby the combination of said opening in said elongated actuating member and said resilient means which permits movement of said pivot pin within said elongated actuating member permits the hand gun to accommodate a multiplicity of approximately equal elongated actuating member lengths.

* * * * *